US007075454B2

(12) United States Patent
Hirsch et al.

(10) Patent No.: US 7,075,454 B2
(45) Date of Patent: Jul. 11, 2006

(54) POWER GENERATION USING BATTERIES WITH RECONFIGURABLE DISCHARGE

(75) Inventors: John Michele Hirsch, Houston, TX (US); Harold J. Vinegar, Houston, TX (US); Robert Rex Burnett, Katy, TX (US); William Mountjoy Savage, Houston, TX (US); Frederick Gordon Carl, Jr., Houston, TX (US)

(73) Assignee: Shell Oil Company, Houston, TX (US)

( * ) Notice: Subject to any disclaimer, the term of this patent is extended or adjusted under 35 U.S.C. 154(b) by 521 days.

(21) Appl. No.: 10/220,253

(22) PCT Filed: Mar. 2, 2001

(86) PCT No.: PCT/US01/06942

§ 371 (c)(1),
(2), (4) Date: Aug. 29, 2002

(87) PCT Pub. No.: WO01/65054

PCT Pub. Date: Sep. 7, 2001

(65) Prior Publication Data

US 2003/0048697 A1 Mar. 13, 2003

Related U.S. Application Data

(60) Provisional application No. 60/186,527, filed on Mar. 2, 2000.

(51) Int. Cl.
*G01V 13/02* (2006.01)

(52) U.S. Cl. ..... 340/854.6; 340/855.8; 340/854.4; 166/250.01; 166/242.1

(58) Field of Classification Search ..... 340/854.6, 340/854.3, 854.4, 855.8; 166/250.01, 242.1
See application file for complete search history.

(56) References Cited

U.S. PATENT DOCUMENTS 525,663 A 9/1894 Mottinger
2,917,004 A 12/1959 Davis et al.

(Continued)

FOREIGN PATENT DOCUMENTS

EP 28296 5/1981

(Continued)

OTHER PUBLICATIONS

Brown.Connolizo and Robertson, West Texas Oil Lifting Short Course and H.W. Winkler, "Misunderstood or overlooked Gas-Lift Design and Equipment Considerations," SPE, p. 351 (1994).

(Continued)

*Primary Examiner*—Albert K. Wong
(74) *Attorney, Agent, or Firm*—Rachel Stiegel

(57) ABSTRACT

A petroleum well for producing petroleum products that incorporates a system adapted to provide power to a downhole device in the well. The system includes a current impedance device and a downhole power storage device. The current impedance device is positioned such that when a time-varying electrical current is transmitted through the portion of a piping structure and/or a voltage potential forms between one side of the current impedance device and another side of the current impedance device. The device is adapted to be electrically connected to the piping structure and/or across the voltage potential formed by the current impedance device, is adapted to be recharged by the electrical current, and is adapted to be electrically connected to the downhole device to provide power to the downhole device as needed.

37 Claims, 4 Drawing Sheets

U.S. PATENT DOCUMENTS

| | | | | |
|---|---|---|---|---|
| 3,083,771 | A | 4/1963 | Chapman | |
| 3,247,904 | A | 4/1966 | Wakefield, Jr. | 166/116 |
| 3,427,989 | A | 2/1969 | Bostock et al. | 103/232 |
| 3,566,963 | A | 3/1971 | Blackledge | 166/189 |
| 3,602,305 | A | 8/1971 | Kisling, III | 116/134 |
| 3,732,728 | A | 5/1973 | Fitzpatrick | 73/151 |
| 3,793,632 | A | 2/1974 | Still | 340/18 |
| 3,814,545 | A | 6/1974 | Waters | 417/90 |
| 3,837,618 | A | 9/1974 | Juhel | 251/129 |
| 3,980,826 | A | 9/1976 | Widmer | 178/68 |
| 4,068,717 | A | 1/1978 | Needham | 166/272 |
| 4,087,781 | A | 5/1978 | Grossi et al. | 340/18 |
| 4,295,795 | A | 10/1981 | Gass et al. | 417/111 |
| 4,393,485 | A | 7/1983 | Redden | |
| 4,468,665 | A | 8/1984 | Thawley et al. | 340/856 |
| 4,545,731 | A | 10/1985 | Canalizo et al. | 417/86 |
| 4,576,231 | A | 3/1986 | Dowling et al. | 166/248 |
| 4,578,675 | A | 3/1986 | MacLeod | |
| 4,596,516 | A | 6/1986 | Scott et al. | 417/58 |
| 4,630,243 | A | 12/1986 | MacLeod | 367/82 |
| 4,648,471 | A | 3/1987 | Bordon | 175/4.55 |
| 4,662,437 | A | 5/1987 | Renfro | 166/65.1 |
| 4,681,164 | A | 7/1987 | Stacks | 166/304 |
| 4,709,234 | A | 11/1987 | Forehand et al. | 340/856 |
| 4,738,313 | A | 4/1988 | McKee | 166/372 |
| 4,739,325 | A | 4/1988 | MacLeod | 340/854 |
| 4,839,644 | A | 6/1989 | Safinya et al. | 340/854 |
| 4,886,114 | A | 12/1989 | Perkins et al. | 166/65.1 |
| 4,901,069 | A | 2/1990 | Veneruso | |
| 4,972,704 | A | 11/1990 | Wellington et al. | 73/155 |
| 4,981,173 | A | 1/1991 | Perkins et al. | 166/66.4 |
| 5,001,675 | A | 3/1991 | Woodward | 367/13 |
| 5,008,664 | A | 4/1991 | More et al. | 340/854 |
| 5,130,706 | A | 7/1992 | Van Steenwyk | 340/854.6 |
| 5,134,285 | A | 7/1992 | Perry et al. | 250/269 |
| 5,160,925 | A | 11/1992 | Dailey et al. | 340/853.3 |
| 5,162,740 | A | 11/1992 | Jewell | 324/347 |
| 5,172,717 | A | 12/1992 | Boyle et al. | 137/155 |
| 5,176,164 | A | 1/1993 | Boyle | 137/155 |
| 5,191,326 | A | 3/1993 | Montgomery | 340/855.5 |
| 5,230,383 | A | 7/1993 | Pringle et al. | 166/66.4 |
| 5,246,860 | A | 9/1993 | Hutchins et al. | 436/27 |
| 5,251,328 | A | 10/1993 | Shaw | 455/73 |
| 5,257,663 | A | 11/1993 | Pringle et al. | 166/66.4 |
| 5,267,469 | A | 12/1993 | Espinoza | 73/40.5 |
| 5,278,758 | A | 1/1994 | Perry et al. | 364/422 |
| 5,331,318 | A | 7/1994 | Montgomery | 340/855.4 |
| 5,353,627 | A | 10/1994 | Diatschenko et al. | 73/19.03 |
| 5,358,035 | A | 10/1994 | Grudzinski | 166/53 |
| 5,367,694 | A | 11/1994 | Ueno | 395/800 |
| 5,394,141 | A | 2/1995 | Soulier | 340/854.4 |
| 5,396,232 | A | 3/1995 | Mathieu et al. | 340/854.5 |
| 5,425,425 | A | 6/1995 | Bankston et al. | 166/377 |
| 5,447,201 | A | 9/1995 | Mohn | 166/375 |
| 5,458,200 | A | 10/1995 | Lagerlef et al. | 166/372 |
| 5,467,083 | A | 11/1995 | McDonald et al. | 340/854.6 |
| 5,473,321 | A | 12/1995 | Goodman et al. | 340/854.9 |
| 5,493,288 | A | 2/1996 | Henneuse | 340/854.4 |
| 5,531,270 | A | 7/1996 | Fletcher et al. | 166/53 |
| 5,561,245 | A | 10/1996 | Georgi et al. | 73/152.02 |
| 5,574,374 | A | 11/1996 | Thompson et al. | 324/338 |
| 5,576,703 | A | 11/1996 | MacLeod et al. | 340/854.4 |
| 5,587,707 | A | 12/1996 | Dickie et al. | 340/870.09 |
| 5,592,438 | A | 1/1997 | Rorden et al. | 367/83 |
| 5,662,165 | A | 9/1997 | Tubel et al. | 166/250.01 |
| 5,723,781 | A | 3/1998 | Pruett et al. | 73/152.18 |
| 5,730,219 | A | 3/1998 | Tubel et al. | 66/250.01 |
| 5,745,047 | A | 4/1998 | Van Gisbergen et al. | 340/853.1 |
| 5,782,261 | A | 7/1998 | Becker et al. | 137/155 |
| 5,797,453 | A | 8/1998 | Becker et al. | 166/117.5 |
| 5,881,807 | A | 3/1999 | Boe et al. | 166/100 |
| 5,883,516 | A | 3/1999 | Van Steenwyk et al. | 324/366 |
| 5,887,657 | A | 3/1999 | Bussear et al. | 166/336 |
| 5,896,924 | A | 4/1999 | Carmody et al. | 166/53 |
| 5,934,371 | A | 8/1999 | Bussear et al. | 166/53 |
| 5,937,945 | A | 8/1999 | Bussear et al. | 166/250.15 |
| 5,941,307 | A | 8/1999 | Tubel | 166/313 |
| 5,955,666 | A | 9/1999 | Mullins | 73/52.18 |
| 5,959,499 | A | 9/1999 | Khan et al. | 330/149 |
| 5,960,883 | A | 10/1999 | Tubel et al. | 166/313 |
| 5,963,090 | A | 10/1999 | Fukuchi | 330/149 |
| 5,971,072 | A | 10/1999 | Huber et al. | 166/297 |
| 5,975,204 | A | 11/1999 | Tubel et al. | 166/250.15 |
| 5,995,020 | A | 11/1999 | Owens et al. | 340/854.9 |
| 6,012,015 | A | 1/2000 | Tubel | 702/6 |
| 6,012,016 | A | 1/2000 | Bilden et al. | 702/12 |
| 6,061,000 | A * | 5/2000 | Edwards | 340/854.6 |
| 6,070,608 | A | 6/2000 | Pringle | 137/155 |
| 6,123,148 | A | 9/2000 | Oneal | 166/118 |
| 6,148,915 | A | 11/2000 | Mullen et al. | 166/278 |
| 6,192,983 | B1 | 2/2001 | Neuroth et al. | 166/250.15 |
| 6,208,586 | B1 | 3/2001 | Rorden et al. | 367/35 |
| 6,334,486 | B1 | 1/2002 | Carmody et al. | 166/53 |
| 6,484,800 | B1 | 11/2002 | Carmody et al. | 166/53 |
| 6,515,592 | B1 * | 2/2003 | Babour et al. | 340/854.4 |
| 6,633,236 | B1 * | 10/2003 | Vinegar et al. | 340/854.4 |

FOREIGN PATENT DOCUMENTS

| | | | |
|---|---|---|---|
| EP | 295178 | A2 | 12/1988 |
| EP | 339825 | | 11/1989 |
| EP | 492856 | A2 | 7/1992 |
| EP | 641916 | A2 | 3/1995 |
| EP | 0 681 090 | A2 | 11/1995 |
| EP | 697500 | A2 | 2/1996 |
| EP | 0 721 053 | A1 | 7/1996 |
| EP | 732053 | A1 | 9/1996 |
| EP | 919696 | A2 | 6/1999 |
| EP | 922835 | A2 | 6/1999 |
| EP | 930518 | A2 | 7/1999 |
| EP | 0 964 134 | A2 | 12/1999 |
| EP | 972909 | A2 | 1/2000 |
| EP | 999341 | A2 | 5/2000 |
| FR | 267713 | | 12/1992 |
| GB | 2083321 | A | 3/1982 |
| GB | 2325949 | A | 12/1998 |
| GB | 2327695 | A | 2/1999 |
| GB | 2338253 | A | 12/1999 |
| WO | 80/00727 | | 4/1980 |
| WO | 93/26115 | | 12/1993 |
| WO | 96 00836 | | 1/1996 |
| WO | 96/24747 | | 8/1996 |
| WO | 97/16751 | | 5/1997 |
| WO | 97/37103 | | 10/1997 |
| WO | 98/20233 | | 5/1998 |
| WO | 99/37044 | | 7/1999 |
| WO | 99/57417 | | 11/1999 |
| WO | 99/60247 | | 11/1999 |
| WO | 00/04275 | | 1/2000 |
| WO | 00 37770 | | 6/2000 |
| WO | 01/ 20126 | A2 | 3/2001 |
| WO | 01/55555 | A1 | 8/2001 |

OTHER PUBLICATIONS

Der Spek, Alex, and Aliz Thomas, "Neural-Net Identification of Flow Regime with Band Spectra of Flow-Generated Sound", SPE Reservoir Eva. & Eng. 2 (6) Dec. 1999, pp. 489-498.

Sakata et al., "Performance Analysis of Long Distance Transmitting of Magnetic Signal on Cylindrical Steel Rod", IEEE Translation Journal on magnetics in Japan, vol. 8, No. 2. Feb. 1993,, pps. 102-106.

Otis Engineering, Aug. 1980, "Heavy Crude Lift System", Field Development Report, OEC 5228, Otis Corp., Dallas, Texas, 1980.
Office Action dated Sep. 22, 2003, U.S. Appl. No. 09/769,048, Bass, 6,662,875. Office Action dated Jan. 29, 2003, U.S. Appl. No. 09/769,048, Bass, 6,662,875.
Office Action dated Oct. 24, 2003, U.S. Appl. No. 09/768,705, Vinegar, 6,715,550. Office Action dated Feb. 21, 2003, U.S. Appl. No. 09/768,705, Vinegar, 6,715,550. Office action dated Feb. 28, 2002, U.S. Appl. No. 09/768,705, Vinegar, 6,715,550.
Office Action dated Jan. 13, 2005 U.S. Appl. No. 10/220,195, Vinegar. Office Action dated Sep. 13, 2004, U.S. Appl. No. 10/220,195, Vinegar. Office Action dqated Jun. 03, 2004, U.S. Appl. No. 10/220,195, Vinegar. Office Action dated Nov. 12, 2003, U.S. Appl. No. 10/220,195, Vinegar.
Office Action dated Sep. 22, 2005, Jul. 07, 2005, U.S. Appl. No. 10/220,252, Vinegar. Office Action dated Jul. 07, 2005, U.S. Appl. No. 10/220,252, Vinegar. Office Action dated Aug. 13, 2004, U.S. Appl. No. 10/220,252, Vinegar. Office Action dated Jan. 02, 2004, U.S. Appl. No. 10/220,252, Vinegar.

* cited by examiner

FIG. 1
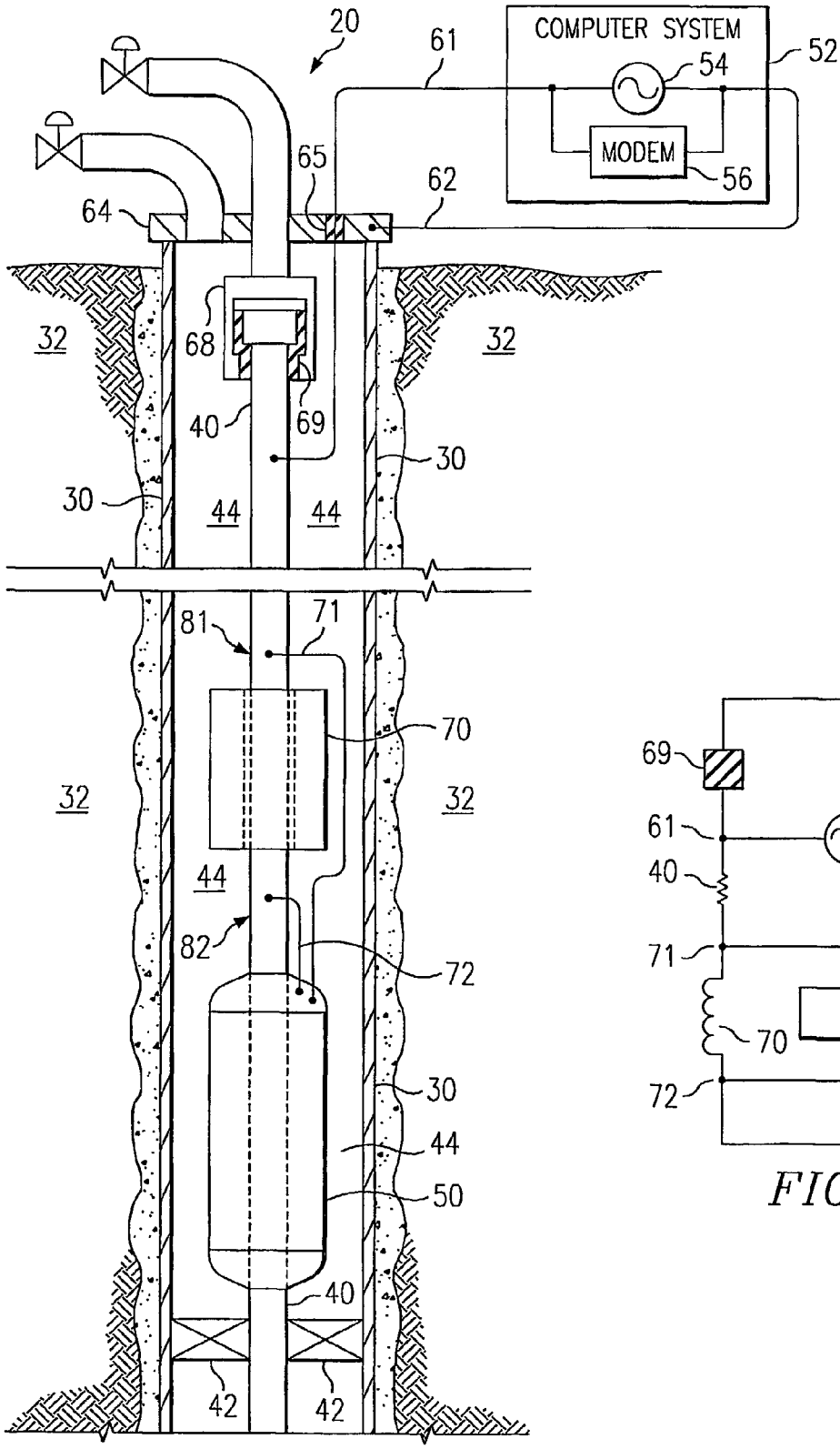
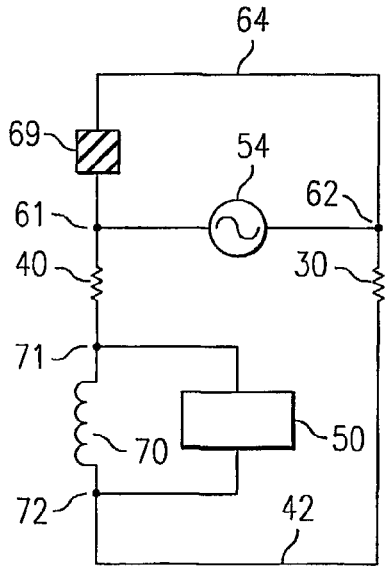
FIG. 2

POWER GENERATION USING BATTERIES WITH RECONFIGURABLE DISCHARGE

CROSS-REFERENCES TO RELATED APPLICATIONS

This application claims the benefit of the following U.S. Provisional Applications, all of which are hereby incorporated by reference:

COMMONLY OWNED AND PREVIOUSLY FILED U.S. PROVISIONAL PATENT APPLICATIONS

| T&K # | Ser. No. | Title | Filing Date |
|---|---|---|---|
| TH 1599 | 60/177,999 | Toroidal Choke Inductor for Wireless and Communication Control | Jan. 24, 2000 |
| TH 1600 | 60/178,000 | Ferromagnetic Choke in Wellhead | Jan. 24, 2000 |
| TH 1602 | 60/178,001 | Controllable Gas-Lift Well and Valve | Jan. 24, 2000 |
| TH 1603 | 60/177,883 | Permanent, Downhole, Wireless, Two-Way Telemetry Backbone Using Redundant Repeater, Spread Spectrum Arrays | Jan. 24, 2000 |
| TH 1668 | 60/177,998 | Petroleum Well Having Downhole Sensors, Communication, and Power | Jan. 24, 2000 |
| TH 1669 | 60/177,997 | System and Method for Fluid Flow Optimization | Jan. 24, 2000 |
| TS 6185 | 60/181,322 | A Method and Apparatus for the Optimal Predistortion of an Electromagnetic Signal in a Downhole Communications System | Feb. 9, 2000 |
| TH 1599x | 60/186,376 | Toroidal Choke Inductor for Wireless Communication and Control | Mar. 2, 2000 |
| TH 1600x | 60/186,380 | Ferromagnetic Choke in Wellhead | Mar. 2, 2000 |
| TH 1601 | 60/186,505 | Reservoir Production Control from Intelligent Well Data | Mar. 2, 2000 |
| TH 1671 | 60/186,504 | Tracer Injection in a Production Well | Mar. 2, 2000 |
| TH 1672 | 60/186,379 | Oilwell Casing Electrical Power Pick-Off Points | Mar. 2, 2000 |
| TH 1673 | 60/186,394 | Controllable Production Well Packer | Mar. 2, 2000 |
| TH 1674 | 60/186,382 | Use of Downhole High Pressure Gas in a Gas Lift Well | Mar. 2, 2000 |
| TH 1675 | 60/186,503 | Wireless Smart Well Casing | Mar. 2, 2000 |
| TH 1677 | 60/186,527 | Method for Downhole Power Management Using Energization from Distributed Batteries or Capacitors with Reconfigurable Discharge | Mar. 2, 2000 |
| TH 1679 | 60/186,393 | Wireless Downhole Well Interval Inflow and Injection Control | Mar. 2, 2000 |
| TH 1681 | 60/186,394 | Focused Through-Casing Resistivity Measurement | Mar. 2, 2000 |
| TH 1704 | 60/186,531 | Downhole Rotary Hydraulic Pressure for Valve Actuation | Mar. 2, 2000 |
| TH 1705 | 60/186,377 | Wireless Downhole Measurement and Control For Optimizing Gas Lift Well and Field Performance | Mar. 2, 2000 |
| TH 1722 | 60/186,381 | Controlled Downhole Chemical Injection | Mar. 2, 2000 |
| TH 1723 | 60/186,378 | Wireless Power and Communications Cross-Bar Switch | Mar. 2, 2000 |

The current application shares some specification and figures with the following commonly owned and concurrently filed applications, all of which are hereby incorporated by reference:

COMMONLY OWNED AND CONCURRENTLY FILED U.S PATENT APPLICATIONS

| T&K # | Ser. No. | Title | Filing Date |
|---|---|---|---|
| TH 1601US | 09/_____ | Reservoir Production Control from Intelligent Well Data | |
| TH 1671US | 09/_____ | Tracer Injection in a Production Well | |
| TH 1672US | 09/_____ | Oil Well Casing Electrical Power Pick-Off Points | |
| TH 1673US | 09/_____ | Controllable Production Well Packer | |
| TH 1674US | 09/_____ | Use of Downhole High Pressure Gas in a Gas-Lift Well | |
| TH 1675US | 09/_____ | Wireless Smart Well Casing | |
| TH 1679US | 09/_____ | Wireless Downhole Well Interval Inflow and Injection Control | |
| TH 1681US | 09/_____ | Focused Through-Casing Resistivity Measurement | |
| TH 1704US | 09/_____ | Downhole Rotary Hydraulic Pressure for Valve Actuation | |
| TH 1705US | 09/_____ | Wireless Downhole Measurement and Control For Optimizing Gas Lift Well and Field Performance | |
| TH 1722US | 09/_____ | Controlled Downhole Chemical Injection | |
| TH 1723US | 09/_____ | Wireless Power and Communications Cross-Bar Switch | |

The current application shares some specification and figures with the following commonly owned and previously filed applications, all of which are hereby incorporated by reference:

COMMONLY OWNED AND PREVIOUSLY FILED U.S PATENT APPLICATIONS

| T&K # | Ser. No. | Title | Filing Date |
|---|---|---|---|
| TH 1599US | 09/_____ | Choke Inductor for Wireless Communication and Control | |
| TH 1600US | 09/_____ | Induction Choke for Power Distribution in Piping Structure | |
| TH 1602US | 09/_____ | Controllable Gas-Lift Well and Valve | |
| TH 1603US | 09/_____ | Permanent Downhole, Wireless, Two-Way Telemetry Backbone Using Redundant Repeater | |
| TH 1668US | 09/_____ | Petroleum Well Having Downhole Sensors, Communication, and Power | |
| TH 1669US | 09/_____ | System and Method for Fluid Flow Optimization | |
| TH 1783US | 09/_____ | Downhole Motorized Flow Control Valve | |
| TS 6185US | 09/_____ | A Method and Apparatus for the Optimal Predistortion of an Electro Magnetic Signal in a Downhole Communications System | |

The benefit of 35 U.S.C. § 120 is claimed for all of the above referenced commonly owned applications. The applications referenced in the tables above are referred to herein as the "Related Applications."

BACKGROUND

1. Field of the Invention

The present invention relates to a petroleum well and a method of operating the well to provide power and power storage downhole. In one aspect, the present invention relates to a rechargeable downhole power storage system with logic controlled charge and discharge circuits.

2. Description of Related Art

The Related Applications describe methods for providing electrical power to and communications with equipment at depth in oil or gas wells. These methods utilize the production tubing as the supply and the casing as the return for the power and communications transmission circuit, or alternatively, the casing and/or tubing as supply with a formation ground as the transmission circuit. In either case the electrical losses which will be present in the transmission circuit will be highly variable, depending on the specific conditions for a particular well. These losses cannot be neglected in the design of power and communications systems for a well, and in extreme cases the methods used to accommodate the losses may be the major determinants of the design.

When power is supplied using the production tubing as the supply conductor and the casing as the return path, the composition of fluids present in the annulus, and especially the possible presence of saline aqueous components in that composition (i.e., electrically conductive fluid), will provide electrical connectivity between the tubing and the casing. If this connectivity is of high conductance, power will be lost when it shorts between tubing and casing before reaching a downhole device.

When power is supplied using the casing as the conductor and formation ground as the return path, electric current leakage through completion cement or concrete (between the casing and the earthen formation) into the earth formation can provide a loss mechanism. The more conductive the cement and earth formation, the more electrical current loss occurs as the current travels from the surface through the casing to a downhole location (e.g., a reservoir location at great depth).

The successful application of systems and methods of providing power and/or communication downhole at depth therefore will often require that a means be provided to accommodate the power losses experienced when the power losses are significant.

All references cited herein are incorporated by reference to the maximum extent allowable by law. To the extent a reference may not be fully incorporated herein, it is incorporated by reference for background purposes, and indicative of the knowledge of one of ordinary skill in the art.

BRIEF SUMMARY OF THE INVENTION

The problems and needs outlined above are largely solved and met by the present invention. In accordance with one aspect of the present invention, a system adapted to provide power to a downhole device in a well is provided. The system comprises a current impedance device and a downhole power storage device. The current impedance device is generally configured for concentric positioning about a portion of a piping structure of the well such that when a time-varying electrical current is transmitted through and along the portion of the piping structure a voltage potential forms between one side of the current impedance device and another side of the current impedance device. The downhole power storage device is adapted to be electrically connected to the piping structure across the voltage potential formed by the current impedance device, is adapted to be recharged by the electrical current, and is adapted to be electrically connected to the downhole device to provide power to the downhole device as needed.

In accordance with another aspect of the present invention, a petroleum well for producing petroleum products is provided. The petroleum well comprises a piping structure, a power source, an induction choke, a power storage module, and an electrical return. The piping structure comprises a first portion, a second portion, and an electrically conductive portion extending in and between the first and second portions. The first and second portions are distally spaced from each other along the piping structure. The power source is electrically connected to the electrically conductive portion of the piping structure at the first portion, the power source is adapted to output time-varying current. The induction choke is located about a portion of the electrically conductive portion of the piping structure at the second portion. The power storage module comprises a power storage device and two module terminals, and is located at the second portion. The electrical return electrically connects between the electrically conductive portion of the piping structure at the second portion and the power source. A first of the module terminals is electrically connected to the electrically conductive portion of the piping structure on a source-side of the induction choke. A second of the module terminals is electrically connected to the electrically conductive portion of the piping structure on an electrical-return-side of the induction choke and/or the electrical return.

In accordance with another aspect of the present invention, a petroleum well for producing petroleum products is provided. The petroleum well comprises a well casing, a production tubing, a power source, a downhole power storage module, a downhole electrically powered device, and a downhole induction choke. The well casing extends within a wellbore of the well, and the production tubing extends within the casing. The power source is located at the surface. The power source is electrically connected to, and adapted to output a time-varying electrical current into, the tubing and/or the casing. The downhole power storage module is electrically connected to the tubing and/or the casing. The downhole electrically powered device is electrically connected to the power storage module. The downhole induction choke is located about a portion of the tubing and/or the casing. The induction choke is adapted to route part of the electrical current through the power storage module by creating a voltage potential between one side of the induction choke and another side of the induction choke. The power storage module is electrically connected across the voltage potential.

In accordance with still another aspect of the present invention, a method of producing petroleum products from a petroleum well is provided. The method comprises the following steps (the order of which may vary): (i) providing a piping structure that comprises an electrically conductive portion extending in and between the surface and downhole; (ii) providing a surface power source that is electrically connected to the electrically conductive portion of the piping structure, wherein the power source is adapted to output time-varying current; (iii) providing a current impedance device that is located about a portion of the electrically conductive portion of the piping structure; (iv) providing a power storage module that comprises a power storage; (v) providing an electrical return that electrically connects between the electrically conductive portion of the piping structure and the power source; (vi) charging the power storage device with the current from the power source while producing petroleum products from the well; and (vii) discharging the power storage device to power an electrically powered device located at the second portion while producing petroleum products from the well. If the electrically powered device comprises a sensor and a modem, the method may further comprise the steps of: (viii) detecting a physical quantity within the well with the sensor; and (ix) transmitting measurement data indicative of the physical quantity of the detecting step to another device located at the first portion using the modem and via the piping structure. The transmitting may be performed when the power storage device is not being charged by the power source to reduce noise.

In accordance with still another aspect of the present invention, a method of powering a downhole device in a well is provided. The method comprising the steps of (the order of which may vary): (A) providing a downhole power storage module comprising a first group of electrical switches, a second group of electrical switches, two or more power storage devices, and a logic circuit; (B) if current is being supplied to the power storage module, (1) closing the first switch group and opening the second switch group to form a parallel circuit across the storage devices, and (2) charging the storage devices; (C) during charging, if the current being supplied to the power storage module stops flowing and the storage devices have less than a first predetermined voltage level, (1) opening the first switch group and closing the second switch group to form a serial circuit across the storage devices, and (2) discharging the storage devices as needed to power the downhole device; (D) during charging if the storage devices have more than the first predetermined voltage level, turning on a logic circuit; and (E) if the logic circuit is on, (1) waiting for the current being supplied to the power storage module to stop flowing, (2) if the current stops flowing, (i) running a time delay for a predetermined amount of time, (a) if the current starts flowing again before the predetermined amount of time passes, continue charging the storage devices, (b) if the predetermined amount of time passes, (b.1) opening the first switch group and closing the second switch group to form the serial circuit across the storage devices, (b.2) discharging the storage devices as needed to power the downhole device, (b.3) if the current starts flowing again, (b.3.1) closing the first switch group and opening the second switch group to form the parallel circuit across the storage devices, and (b.3.2) charging the storage devices, and (b.4) if the storage devices drop below a second predetermined voltage level, turning the logic circuit off. If the predetermined time passes on the time delay, if the current is not being supplied to the power storage module, and if the storage devices are above the second predetermined voltage level, the method may further comprise the step of transmitting data from the downhole device to a surface modem.

Thus, the problems outlined above are largely solved by the provision of a way to store electrical energy downhole, to replenish this energy as needed, and to distribute this power efficiently by using logic algorithms or communications to control the configuration of the power distribution paths.

The storage mechanism of the power storage devices may be chemical, as in batteries of secondary cells, or electrical, as in capacitors, ultracapacitors, or supercapacitors. By controlling the charge-discharge duty cycle of the storage devices, even a severely restricted availability of power downhole can be used to charge the storage devices, and the power can be extracted to drive electrical or electronic equipment at a much higher rate than the charge rate. Typical electrical equipment may include (but is not limited to) electric motors, sleeve and valve actuators, and/or acoustic sources. These typically require high power during use but are often operated only intermittently on command.

A conventional well completion with a single borehole may produce from multiple zones, and a multilateral completion can have a number of laterals communicating with the surface through the main borehole, thus forming a tree-like branching structure. In the general case therefore, a multiplicity of downhole modules for power storage and communications may be installed in the well. Power is supplied to each module from the surface via a piping structure of the well. Communications allow each downhole module to be individually addressed and controlled.

By the nature of their function, the downhole devices are placed in groups. Relative to their distance from the surface, the spacing between downhole devices within a group is small. This proximity allows power and/or communications to be transferred from one downhole device to another using the tubing and/or casing as the power transmission and/or communication path between individual downhole devices. Such a power distribution method depends on the provision of control communications to configure the connections between the power storage devices in each device, and loads which may be in another device. Using this method, the power available from more than one device in a group may be applied to a single point of use, allowing higher power consumption at that point of use than would be allowed if each device relied on only its own local power storage capacity.

Similarly in the case where power storage within an individual downhole device has failed, that module may be powered from adjacent devices, and its power storage devices removed from service. An important characteristic of power storage devices (both chemical cells and capacitors) is that their individual operating power may be limited to values that are lower than what is needed to operate electronics or electrical equipment. In cases where downhole power is severely restricted by losses in the power transmission path, the power that can be developed may be restricted to values lower than would allow electrical circuits to operate normally. Therefore, among other things, the present invention provides a solution to such a problem.

BRIEF DESCRIPTION OF THE DRAWINGS

Other objects and advantages of the invention will become apparent upon reading the following detailed description and upon referencing the accompanying drawings, in which:

FIG. 1 is a schematic showing a petroleum production well in accordance with a preferred embodiment of the present invention;

FIG. 2 is a simplified electrical schematic of the electrical circuit formed by the well of FIG. 1;

DETAILED DESCRIPTION OF THE INVENTION

Figure 3A:
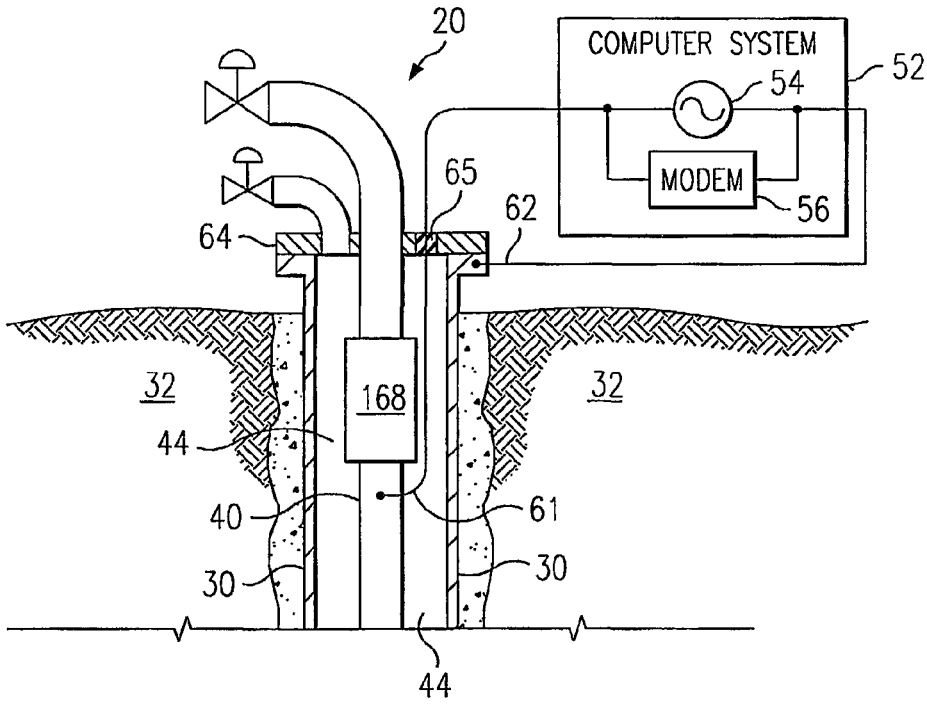
FIG. 3A is a schematic showing an upper portion of a petroleum production well in accordance with another preferred embodiment of the present invention.

Referring now to the drawings, wherein like reference numbers are used herein to designate like elements throughout the various views, preferred embodiments of the present invention are illustrated and further described, and other possible embodiments of the present invention are described. The figures are not necessarily drawn to scale, and in some instances the drawings have been exaggerated and/or simplified in places for illustrative purposes only. One of ordinary skill in the art will appreciate the many possible applications and variations of the present invention based on the following examples of possible embodiments of the present invention, as well as based on those embodiments illustrated and discussed in the Related Applications, which are incorporated by reference herein to the maximum extent allowed by law.

As used in the present application, a "piping structure" can be one single pipe, a tubing string, a well casing, a pumping rod, a series of interconnected pipes, rods, rails, trusses, lattices, supports, a branch or lateral extension of a well, a network of interconnected pipes, or other similar structures known to one of ordinary skill in the art. A preferred embodiment makes use of the invention in the context of a petroleum well where the piping structure comprises tubular, metallic, electrically-conductive pipe or tubing strings, but the invention is not so limited. For the present invention, at least a portion of the piping structure needs to be electrically conductive, such electrically conductive portion may be the entire piping structure (e.g., steel pipes, copper pipes) or a longitudinal extending electrically conductive portion combined with a longitudinally extending non-conductive portion. In other words, an electrically conductive piping structure is one that provides an electrical conducting path from a first portion where a power source is electrically connected to a second portion where a device and/or electrical return is electrically connected. The piping structure will typically be conventional round metal tubing, but the cross-section geometry of the piping structure, or any portion thereof, can vary in shape (e.g., round, rectangular, square, oval) and size (e.g., length, diameter, wall thickness) along any portion of the piping structure. Hence, a piping structure must have an electrically conductive portion extending from a first portion of the piping structure to a second portion of the piping structure, wherein the first portion is distally spaced from the second portion along the piping structure.

The terms "first portion" and "second portion" as used herein are each defined generally to call out a portion, section, or region of a piping structure that may or may not extend along the piping structure, that can be located at any chosen place along the piping structure, and that may or may not encompass the most proximate ends of the piping structure.

The term "modem" is used herein to generically refer to any communications device for transmitting and/or receiving electrical communication signals via an electrical conductor (e.g., metal). Hence, the term "modem" as used herein is not limited to the acronym for a modulator (device that converts a voice or data signal into a form that can be transmitted)/demodulator (a device that recovers an original signal after it has modulated a high frequency carrier). Also, the term "modem" as used herein is not limited to conventional computer modems that convert digital signals to analog signals and vice versa (e.g., to send digital data signals over the analog Public Switched Telephone Network). For example, if a sensor outputs measurements in an analog format, then such measurements may only need to be modulated (e.g., spread spectrum modulation) and transmitted—hence no analog/digital conversion needed. As another example, a relay/slave modem or communication device may only need to identify, filter, amplify, and/or retransmit a signal received.

The term "valve" as used herein generally refers to any device that functions to regulate the flow of a fluid. Examples of valves include, but are not limited to, bellows-type gas-lift valves and controllable gas-lift valves, each of which may be used to regulate the flow of lift gas into a tubing string of a well. The internal and/or external workings of valves can vary greatly, and in the present application, it is not intended to limit the valves described to any particular configuration, so long as the valve functions to regulate flow. Some of the various types of flow regulating mechanisms include, but are not limited to, ball valve configurations, needle valve configurations, gate valve configurations, and cage valve configurations. The methods of installation for valves discussed in the present application can vary widely.

The term "electrically controllable valve" as used herein generally refers to a "valve" (as just described) that can be opened, closed, adjusted, altered, or throttled continuously in response to an electrical control signal (e.g., signal from a surface computer or from a downhole electronic controller module). The mechanism that actually moves the valve position can comprise, but is not limited to: an electric motor; an electric servo; an electric solenoid; an electric switch; a hydraulic actuator controlled by at least one electrical servo, electrical motor, electrical switch, electric solenoid, or combinations thereof; a pneumatic actuator controlled by at least one electrical servo, electrical motor, electrical switch, electric solenoid, or combinations thereof; or a spring biased device in combination with at least one electrical servo, electrical motor, electrical switch, electric solenoid, or combinations thereof. An "electrically controllable valve" may or may not include a position feedback sensor for providing a feedback signal corresponding to the actual position of the valve.

The term "sensor" as used herein refers to any device that detects, determines, monitors, records, or otherwise senses the absolute value of or a change in a physical quantity. A sensor as described herein can be used to measure physical quantities including, but not limited to: temperature, pressure (both absolute and differential), flow rate, seismic data, acoustic data, pH level, salinity levels, tracer presence, tracer concentration, chemical concentration, valve positions, or almost any other physical data.

The phrase "at the surface" as used herein refers to a location that is above about fifty feet deep within the Earth. In other words, the phrase "at the surface" does not necessarily mean sitting on the ground at ground level, but is used more broadly herein to refer to a location that is often easily or conveniently accessible at a wellhead where people may be working. For example, "at the surface" can be on a table in a work shed that is located on the ground at the well platform, it can be on an ocean floor or a lake floor, it can be on a deep-sea oil rig platform, or it can be on the 100the floor of a building. Also, the term "surface" may be used herein as an adjective to designate a location of a component or region that is located "at the surface." For example, as used herein, a "surface" computer would be a computer located "at the surface."

The term "downhole" as used herein refers to a location or position below about fifty feet deep within the Earth. In other words, "downhole" is used broadly herein to refer to a location that is often not easily or conveniently accessible from a wellhead where people may be working. For example in a petroleum well, a "downhole" location is often at or proximate to a subsurface petroleum production zone, irrespective of whether the production zone is accessed vertically, horizontally, lateral, or any other angle therebetween. Also, the term "downhole" is used herein as an adjective describing the location of a component or region. For example, a "downhole" device in a well would be a device located "downhole," as opposed to being located "at the surface."

As used in the present application, "wireless" means the absence of a conventional, insulated wire conductor e.g. extending from a downhole device to the surface. Using the tubing and/or casing as a conductor is considered "wireless."

FIG. 1 is a schematic showing a gas-lift petroleum production well 20 in accordance with a preferred embodiment of the present invention. The well 20 has a well casing 30 extending within a wellbore through a formation 32 to a production zone (not shown) farther downhole. A production tubing 40 extends within the well casing 30 for conveying fluids (e.g., oil, gas) from downhole to the surface during production operations. A packer 42 is located downhole within the casing 30 and about the tubing 40. The packer 42 is conventional and it hydraulically isolates a portion of the well 20 above the production zone to allow pressurized gas to be input into an annulus 44 formed between the casing 30 and tubing 40. During gas-lift operation, pressurized gas is input at the surface into the annulus 44 for further input into the tubing 40 for providing gas-lift for fluids therein. Hence, the petroleum production well 20 shown in FIG. 1 is similar to a conventional well in construction, but with the incorporation of the present invention.

An electrical circuit is formed using various components of the well 20 in FIG. 1. The electrical well circuit formed is used to provide power and/or communications to an electrically powered downhole device 50. A surface computer system 52 provides the power and/or communications at the surface. The surface computer system 52 comprises a power source 54 and a master modem 56, but the surface equipment components and configuration may vary. The power source 54 is adapted to output a time-varying current. The time-varying current is preferably alternating current (AC), but it can also be a varying direct current. Preferably, the communications signal provided by the surface computer system 52 is a spread spectrum signal, but other forms of modulation or predistortion can be used in alternative. A first computer terminal 61 of the surface computer system 52 is electrically connected to the tubing 40 at the surface. The first computer terminal 61 passes through the hanger 64 at an insulated seal 65, and is thus electrically insulated from the hanger 64 as it passes through it at the seal 65. A second computer terminal 62 of the surface computer system 52 is electrically connected to the well casing 30 at the surface.

The tubing 40 and casing 30 act as electrical conductors for the well circuit. In a preferred embodiment, as shown in FIG. 1, the tubing 40 acts as a piping structure for conveying electrical power and/or communications between the surface computer system 52 and the downhole device 50, and the packer 42 and casing 30 act as an electrical return. An insulated tubing joint 68 is incorporated at the wellhead below the hanger 64 to electrically insulate the tubing 40 from the hanger 64 and the casing 30 at the surface. The first computer terminal 61 is electrically connected to the tubing 40 below the insulated tubing joint 68. An induction choke 70 is located downhole about the tubing 40. The induction choke 70 is generally ring shaped and is generally concentric about the tubing 40. The induction choke 70 comprises a ferromagnetic material, and it is unpowered. As described in further detail in the Related Applications, the induction choke 70 functions based on its size (mass), geometry, and magnetic properties, as well as its spatial relationship relative to the tubing 40. Both the insulated tubing joint 68 and induction choke 70 function to impede an AC signal applied to the tubing 40. In other embodiments, the induction choke 70 may be located about the casing 30. The downhole device 50 has two electrical device terminals 71, 72. A first of the device terminals 71 is electrically connected to the tubing 40 on a source-side 81 of the induction choke 70. A second of the device terminals 72 is electrically connected to the tubing 40 on an electrical-return-side 82 of the induction choke 70. The packer 42 provides an electrical connection between the tubing 40 and the casing 30 downhole. However, the tubing 40 and casing 30 may also be electrically connected downhole by a conduction fluid (not shown) in the annulus 44 above the packer 42, or by another way. Preferably there will be little or no conductive fluid in the annulus 44 above the packer 42, but in practice it sometimes cannot be prevented.

FIG. 2 is a simplified electrical schematic illustrating the electrical circuit formed in the well 20 of FIG. 1. In operation, power and/or communications (supplied by the surface computer system 52) are imparted into the tubing 40 at the surface below the insulated tubing joint 68 via the first computer terminal 61. The time-varying current is hindered from flowing from the tubing 40 to the casing 30 (and to the second computer terminal 62) via the hanger 64 due to the insulators 69 in the insulated tubing joint 68. However, the time-varying current flows freely downhole along the tubing 40 until the induction choke 70 is encountered. The induction choke 70 provides a large inductance that impedes most of the current (e.g., 90%) from flowing through the tubing 40 at the induction choke 70. Hence, a voltage potential forms between the tubing 40 and the casing 30 due to the induction choke 70. Other methods of conveying AC signals on the tubing are disclosed in the Related Applications. The voltage potential also forms between the tubing 40 on the source-side 81 of the induction choke 70 and the tubing 40 on the electrical-return-side 82 of the induction choke 70. Because the downhole device 50 is electrically connected across the voltage potential, most of the current imparted into the tubing 40 that is not lost along the way is routed through the downhole device 50, and thus provides power and/or communications to the downhole device 50. After passing through the downhole device 50, the current returns to the surface computer system 52 via the packer 42, the casing 30, and the second computer terminal 62. When the current is AC, the flow of the current just described will also be reversed through the well 20 along the same path.

Other alternative ways to develop an electrical circuit using a piping structure of a well and at least one induction choke are described in the Related Applications, many of which can be applied in conjunction with the present invention to provide power and/or communications to the electrically powered downhole device 50 and to form other embodiments of the present invention. Notably the Related Applications describe methods based on the use of the casing rather than the tubing to convey power from the surface to downhole devices, and the present invention is applicable in casing-conveyed embodiments.

If other packers or centralizers (not shown) are incorporated between the insulated tubing joint 68 and the packer 42, they can incorporate an electrical insulator to prevent electrical shorts between the tubing 40 and the casing 30. Such electrical insulation of additional packers or centralizers may be achieved in various ways apparent to one of ordinary skill in the art.

Figure 3B:
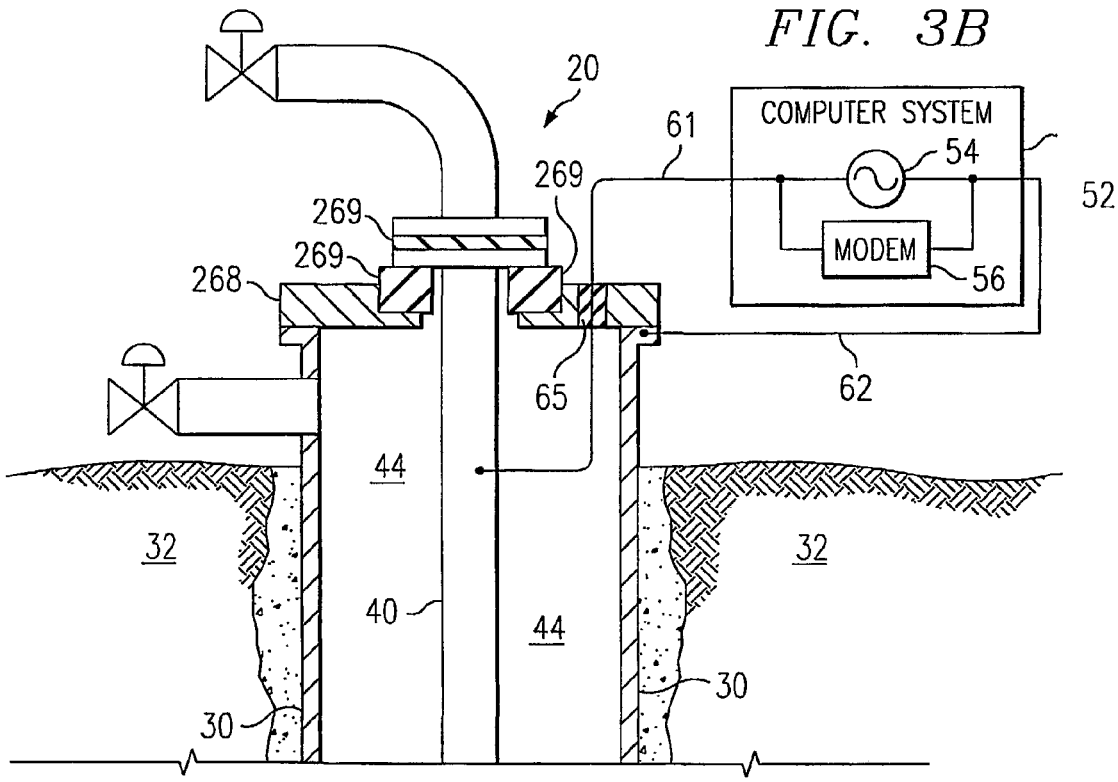
FIG. 3B is a schematic showing an upper portion of a petroleum production well in accordance with yet another preferred embodiment of the present invention.

In alternative to (or in addition to) the insulated tubing joint 68, another induction choke 168 (see FIG. 3A) can be placed about the tubing 40 above the electrical connection location for the first computer terminal 61 to the tubing 40, and/or the hanger 64 may be an insulated hanger 268 (see FIG. 3B) having insulators 269 to electrically insulate the tubing 40 from the casing 30.

Figure 4:
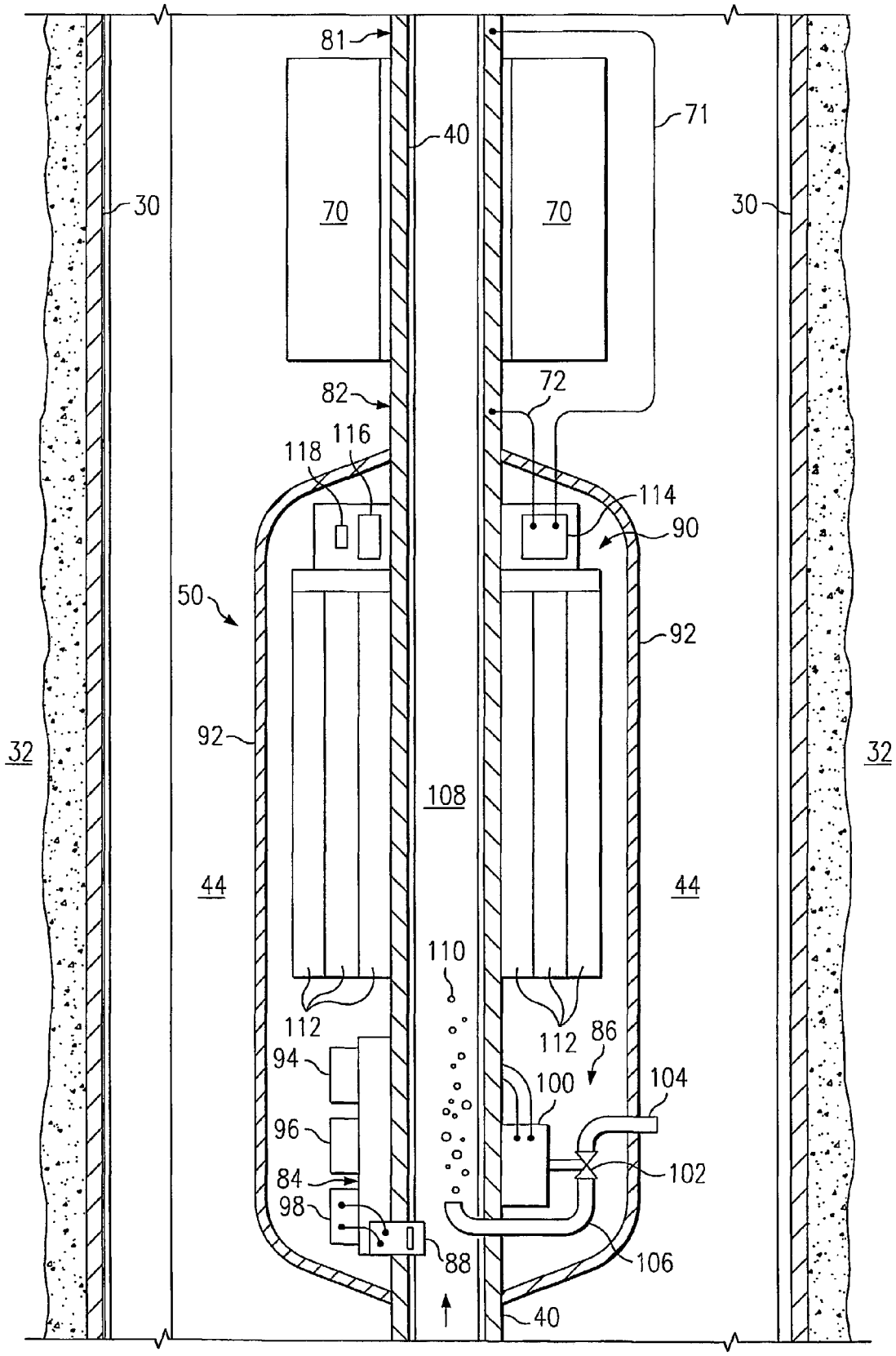
FIG. 4 is an enlarged sectional view of a downhole portion of the well shown in FIG. 1.

FIG. 4 is an enlarged cutaway view of a portion of the well 20 of FIG. 1 showing the induction choke 70 and the downhole device 50. For the preferred embodiment shown in FIG. 1, the downhole device 50 comprises a communications and control module 84, an electrically controllable gas-lift valve 86, a sensor 88, and a power storage module 90. Preferably the components of the downhole device 50 are all contained in a single, sealed tubing pod 92 together as one module for ease of handling and installation, as well as to protect the components from the surrounding environment. However, in other embodiments of the present invention, the components of the downhole device 50 can be separate (i.e., no tubing pod 92) or combined in other combinations.

The communications and control module 84 comprises an individually addressable modem 94, a motor controller 96, and a sensor interface 98. Because the modem 94 of the downhole device 50 is individually addressable, more than one downhole device may be installed and operated independently of others within a same well 20. The communications and control module 84 is electrically connected to the power storage module 90 (connection wires not shown in FIG. 4) for receiving power from the power storage module 90 as needed. The modem 94 is electrically connected to the tubing 40 via the first and second device terminals 71, 72 (electrical connections between modem 94 and device terminals 71, 72 not shown). Hence, the modem 94 can communicate with the surface computer system 52 or with other downhole devices (not shown) using the tubing 40 and/or casing 30 as an electrical conductor for the signal.

The electrically controllable gas-lift valve 86 comprises an electric motor 100, a valve 102, an inlet 104, and a outlet nozzle 106. The electric motor 100 is electrically connected to the communications and control module 84 at the motor controller 96 (electrical connections between motor 100 and motor controller 96 not shown). The valve 102 is mechanically driven by the electric motor 100 in response to control signals from the communications and control module 84. Such control signals from the communications and control module 84 may be from the surface computer system 52 or from another downhole device (not shown) via the modem 94. In alternative, the control signal for controlling the electric motor 100 may be generated within the downhole device 50 (e.g., in response to measurements by the sensor 88). Hence, the valve 102 can be adjusted, opened, closed, or throttled continuously by the communications and control module 84 and/or the surface computer system 52. Preferably the electric motor 100 is a stepper motor so that the valve 102 can be adjusted in known increments. When there is pressurized gas in the annulus 44, it can be controllably injected into an interior 108 of the tubing 40 with the electrically controllable valve 86 (via the inlet 104, the valve 102, and the outlet nozzle 106) to form gas bubbles 110 within the fluid flow to lift the fluid toward the surface during production operations.

The sensor 88 is electrically connected to the communications and control module 84 at the sensor interface 98. The sensor 88 may be any type of sensor or transducer adapted to detect or measure a physical quantity within the well 20, including (but not limited to): pressure, temperature, acoustic waveforms, chemical composition, chemical concentration, tracer material presence, or flow rate. In other embodiments there may be multiple sensors. Also, the placement of the sensor 88 may vary. For example, in an enhanced form there may be an additional or alternative sensor adapted to measure the pressure within the annulus 44.

Still referring to FIG. 4, the power storage module 90 comprises power storage devices 112, a power conditioning circuit 114, a logic circuit 116 and a time delay circuit 118, all of which are electrically connected together to form the power storage module 90 (electrical connections not shown in FIG. 4). The power storage module 90 is electrically connected to the tubing 40 across the voltage potential formed by the induction choke 70, as described above. The power storage module 90 is also electrically connected to the communications and control module 84 (electrical connections not shown in FIG. 4) to provide power to it when power is not available from the surface computer system 52 via the tubing 40 and/or casing 30. The power storage module 90 and the communications and control module 84 can also be switchably wired such that the communications and control module 84 (and hence the modem 94, electric motor 100, and sensor 88) are always only powered by the power storage devices 112, and the power storage devices are repeatedly recharged by the power source 54 from the surface via the tubing 40 and/or casing 30.

In the preferred embodiment shown in FIG. 4, the power storage devices 112 are capacitors. In alternative, the power storage devices 112 may be rechargeable batteries adapted to store and discharge electrical power as needed.

The logic circuit 116 is preferably powered from the device terminals 71, 72 (electrical power connections for logic circuit not shown), rather than by power storage devices 112. The power to the logic circuit 116 from the device terminals 71, 72 may be power from other downhole devices (not shown), or from the surface power source 54 and fed through the bridge 136 to provide DC to the logic circuit. Thus, the logic circuit 116 can change the switches 121, 122, 131, 132 in the power conditioning circuit 114 when the power storage devices 112 are uncharged. In alternative, the logic circuit 116 may also receive power from the power storage devices 112 when available and from the device terminals 71, 72, or the logic circuit 116 may comprise its own rechargeable battery to allow for changing the switches 121, 122, 131, 132 in the power conditioning circuit 114 when the power storage devices 112 are uncharged and when there is no power available via the device terminals 71, 72. Also, the logic circuit 116 may be powered only by one or more of the power storage devices 112.

Figure 5:
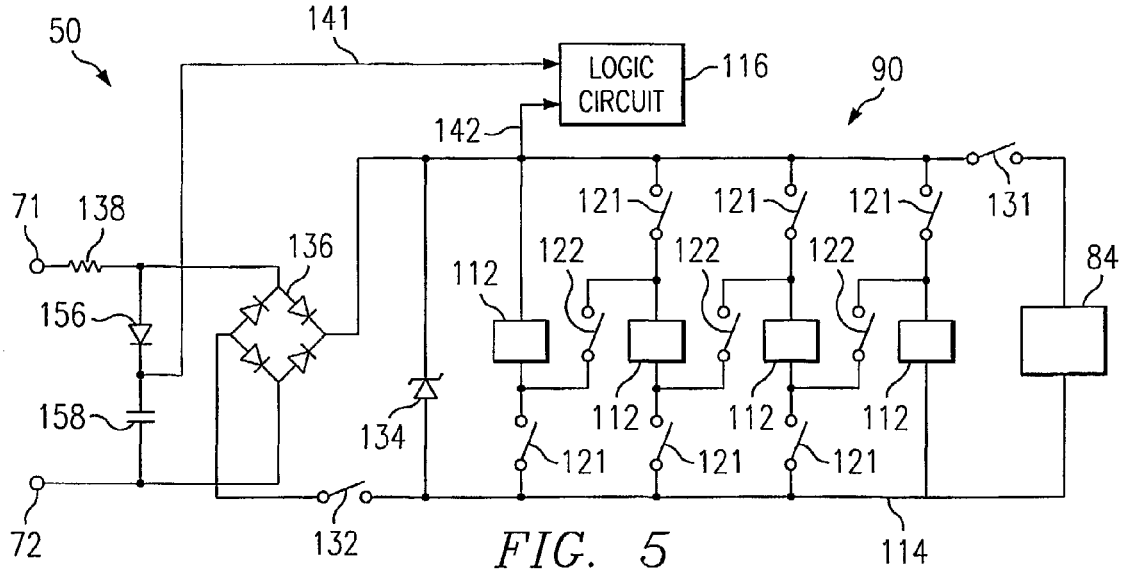
FIG. 5 is a simplified electrical schematic for the downhole device of FIGS. 1 and 4, with particular emphasis on the power storage module.

FIG. 5 is a simplified electrical schematic for the downhole device 50 of FIGS. 1 and 4, with particular emphasis on the power storage module 90. The power conditioning circuit 114 of the power storage module 90 comprises a first group of switches 121, a second group of switches 122, a first load switch 131, a second load switch 132, a Zener diode 134, and a full-wave bridge rectifier 136. The power conditioning circuit 114 is adapted to provide a parallel circuit configuration across the power storage devices 112 for charging and a serial circuit configuration across the power storage devices 112 for discharging.

In operation, the power conditioning circuit 114 shown in FIG. 5 allows for many possible circuit configurations. When the first group of switches 121 are closed and the second group of switches 122 are open, a parallel circuit configuration is provided across the storage devices 112, and hence the voltage level across all of the storage devices 112 is the same and they can handle a larger current load together. When the first group of switches 121 are open and the second group of switches 122 are closed, a serial circuit configuration is formed across the storage devices 112, and hence the voltage levels of the storage devices 112 are added together to form a larger total voltage in the circuit 114.

Also, the power conditioning circuit 114 shown in FIG. 5 allows for many possible circuit configurations for powering the communications and control module 84 electrically connected to it. When power is needed by the communications and control module 84 or sent to the communications and control module 84, the first load switch 131 is closed, but the positions of the other switches can vary. Because power to the communications and control module 84 can be controlled with the first load switch 131, the charges in the storage devices 112 can be conserved when the communications and control module 84 is not needed and the use of the communications and control module 84 can be controlled (i.e., communications and control module 84 on/off). The second load switch 132 is provided to separate the power conditioning circuit 114 from the well circuit. For example, if the communications and control module 84 is to be powered only by the power storage devices 112, then the second load switch 132 is opened. Thus with the first load switch 131 closed, the second load switch 132 open, the first switch group 121 open, and the second switch group 122 closed, the serial circuit formed provides a voltage level to the communications and control module 84 equal to the sum of the power storage device 112 voltage levels. With the first load switch 131 closed, the second load switch 132 open, the first switch group 121 closed, and the second switch group 122 open, the parallel circuit formed provides a voltage level to the communications and control module 84 equal to that of each storage device 112, which is lower than that of the serial configuration. But, the parallel configuration provides a lower voltage over a longer duration or under higher current loads drawn by the communications and control module 84 than that of the serial configuration. Hence, the preferable circuit configuration (parallel or serial) for powering a device will depend on the power needs of the device.

Power to the communications and control module 84 also may be provided solely from the well circuit (from the first and second device terminals 71, 72) by closing the first load switch 131, closing the second load switch 132, and opening the first and second switch groups 121, 122. Also, such a configuration for the power conditioning circuit 114 may be desirable when communication signals are being sent to or from the communications and control module 84. The Zener diode 134 provides overvoltage protection, but other types of overvoltage and/or overcurrent protectors can be provided as well. The power and/or communications provided to first and second device terminals 71, 72 (via the tubing 40 and/or casing ) may be supplied by the surface power source 54, another downhole device (not shown), and/or another downhole power storage module (not shown). Furthermore, power to the communications and control module 84 may be provided by the well circuit and the power storage devices 112 by closing the first load switch 131, closing the second load switch 132, and closing the first or second switch group 121, 122.

For charging the power storage devices 112 with the well circuit, the second load switch 132 is closed to connect the power conditioning circuit 114 to the well circuit via the bridge 136. It is preferable to charge the storage devices 112 with the parallel circuit configuration across the storage devices 112 (i.e., first switch group 121 closed and second switch group 122 open) and the communications and control module 84 load disconnected (first load switch 131 open), but the storage devices 112 can also be charged (less efficiently) while powering the communications and control module 84. Thus during a charging operation in the preferred embodiment shown in FIGS. 1, 4, and 5, AC power from the power source 54 is imparted into the well circuit at the surface and routed through the first and second device terminals 71, 72 by the induction choke 70. The AC power passes through an impedance matching resistor 138 and is rectified by the bridge 136 to generate a DC voltage across the storage devices 112, which charges the storage devices 112.

Switching between charging and discharging configurations or altering the switch configurations may be an automated process controlled internally within the downhole device 50, it may be controlled externally by control signals from the surface computer system 52 or from another downhole device or a downhole controller (not shown), or it may be a combination of these ways. Because external commands cannot be received or acted upon until the downhole device 50 has power available, it is desirable to include an automatic control circuit that (i) detects the discharged condition of the storage devices 112, (ii) detects the availability of AC power from the surface power source 52 via the tubing 40 and/or the casing 30, and (iii) when both conditions are met, automatically recharges the storage devices 112. Therefore, switching in the preferred embodiment of FIGS. 1, 4, and 5 is an automated process automatically controlled by the logic circuit 116.

Figure 6:
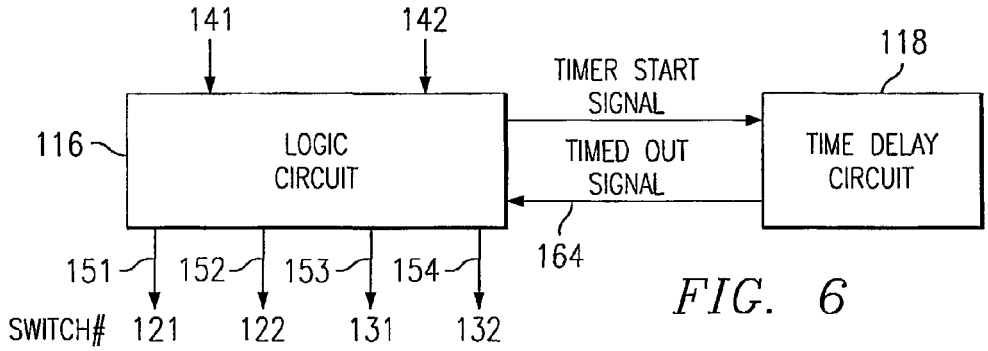
FIG. 6 is a diagram illustrating the input and output signals for the logic circuit of FIGS. 4 and 5.

Referring to FIGS. 5 and 6, the logic circuit 116 receives two input signals 141, 142, which control the four output signals 151–154 from the logic circuit 116. One of the input signals 141 corresponds to whether there is AC power provided across the device terminals 71, 72 (e.g., from the surface power source 54). The input signal 141 is driven by a half-wave rectifier 156 and a capacitor 158, which are used together to detect the presence of AC power across the device terminals 71, 72. The other input signal 142 provides information about the voltage level across the power storage devices 112, which is an indicator of the charge level remaining in the power storage devices 112. A first of the output signals 151 from the logic circuit 116 provides a command to open or close the first switch group 121. A second of the output signals 152 from the logic circuit 116 provides a command to open or close the second switch group 122. A third of the output signals 153 provides a command to open or close the first load switch 131 connecting the communications and control module 84 to the power conditioning circuit 114. A fourth of the output signals 154 provides a command to open or close the second load switch 132 connecting the device terminals 71, 72 to the power conditioning circuit 114 via the bridge 136.

Figure 7:
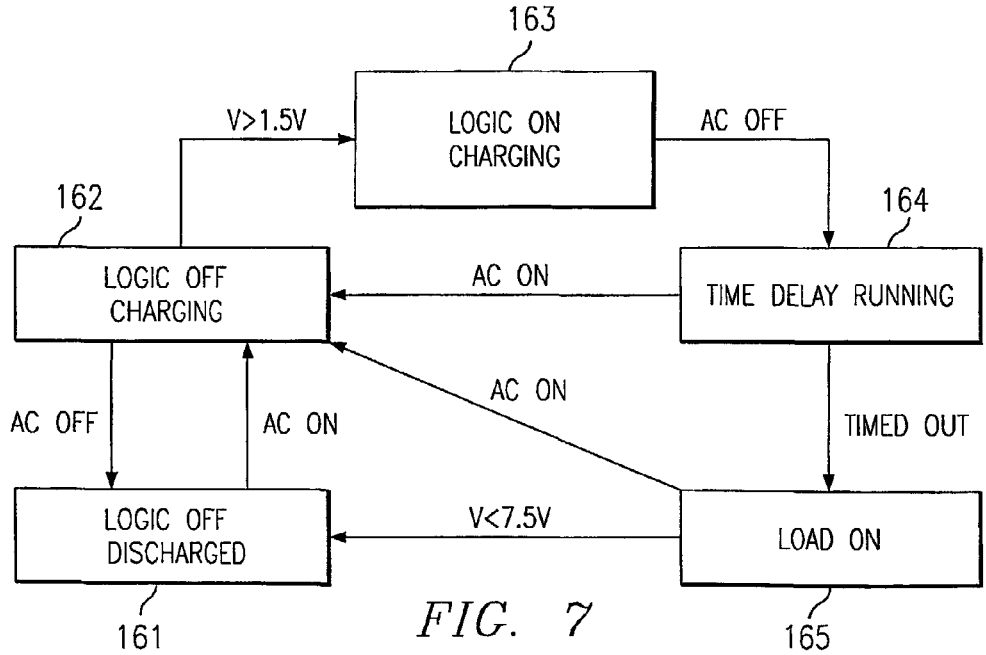
FIG. 7 is a state diagram illustrating a logic algorithm used by the downhole device of FIGS. 1, 4, and 5.

The logic algorithm implemented in the preferred embodiment of FIGS. 1, 4, 5, and 6 is illustrated by a state diagram shown in FIG. 7. In the state diagram of FIG. 7, the blocks represent states of the system, and the arrows represent transitions between states that occur when a condition is met or an event occurs. Starting at the lower-left block 161, which is the initial or default state, the first switch group 121 is closed, the second switch group 122 is open, the first load switch 131 is open, and the second load switch 132 is closed. Hence, the power storage devices 112 are configured in parallel and are ready to receive charge from the bridge 136. Their state of charge is signalled on connector 142 and is less than 1.5 Volts, however the logic circuit 116 is off. In state 161 the system is considered inactive, the power storage devices are considered to be discharged, but are ready to receive charge.

When AC flows through the well circuit across the device terminals 71, 72, the storage devices 112 begin to charge and the system transitions to state 162. In state 162, if the storage devices 112 have charged to the point where their voltage reaches 1.5 Volts the system transitions to state 163, the logic circuit 116 is activated, and is then able to sense the voltages on lines 141, 142. In state 162, if the flow of AC ceases before the storage devices 112 have reached 1.5 Volts, the circuit transitions back to state 161, inactive but ready to receive more charge.

In state 163, storage devices 112 continue to receive charge, and the logic circuit 116 monitors the voltage on lines 141 and 142. When AC power is switched off, the logic circuit senses this condition by means of line 141, and the system transitions to state 164.

In state 164, the logic circuit 116 opens switch group 121, closes switch group 122, opens switch 132, and starts a time delay circuit. The purpose of the delay is to allow switching transients from the parallel-to-serial reconfiguration of devices 112 to die down: the delay is brief, of the order of milliseconds. If AC power is turned on again while the delay timer is still running, the system transitions back to state 162, otherwise the system transitions to state 165 when the delay has timed out.

In state 165, logic circuit 116 maintains switch group 121 open and switch group 122 closed, but closes switch 131 to pass power to the main load 84. The system remains in state 165 until either AC power comes on again, as sensed on line 141, or until the storage devices have discharged such that the voltage sensed on line 142 has dropped below 7.5 Volts. If AC power appears, the system transitions to state 162, with its associated settings for switches 121, 122, 131 and 132. If the storage devices discharge before AC re-appears, the system transitions to state 161 with its associated settings for switches 121, 122, 131, and 132.

The system described by reference to FIG. 7 ensures that the downhole equipment can be activated from the inactive and discharged state 161 by a defined procedure, and once it is charged and active it enters a known state. It is widely understood that meeting this requirement is a necessary element in a successful implementation for inaccessible devices which operate using stored power when the power storage devices may become discharged.

As described in reference to the FIG. 7 state diagram, the downhole device 50 transmits data or measurement information uphole to the surface computer system 52 using the modem 94 only while the AC power from the surface power source 54 is not being transmitted. This helps to eliminate noise during uphole transmission from the downhole device 50 to the surface computer system 52. The algorithm control logic of the logic circuit 116 of the preferred embodiment described herein is merely illustrative and can vary, as will be apparent to one of ordinary skill in the art.

By controlling the charge-discharge duty cycle of the storage devices 112 with the power condition circuit 114 and the logic circuit 116, even a severely restricted availability of power downhole can be used to charge the storage devices 112, and the power can be extracted to drive electrical or electronic equipment at a much higher rate than the charge rate. Typical downhole electrical equipment may include (but are not limited): motors, sleeve and valve actuators, and acoustic sources. Such electrical equipment often require high power during use, but are operated only intermittently on command. Hence, the present invention provides ways to charge the downhole power storage devices 112 at one rate (e.g., restricted power availability) and discharge the stored power in power storage devices 112 at another rate (e.g., brief, high-power loads). Therefore, among other things, the present invention can overcome the many of the difficulties caused by restrictions on power available downhole.

A characteristic of power storage devices 112 (both chemical cells and capacitors) is that their individual operating power may be limited to values that are lower than that needed to operate downhole electronics or electrical equipment. In cases where downhole power is severely restricted by losses in the power transmission path, the power that can be developed may be restricted to values lower than needed to allow electrical circuits to operate normally.

By the nature of their functions, downhole devices 50 are often placed in groups within a well. Relative to their distance from the surface, the spacing between downhole devices within a group is small. Because of their relatively close proximity to one another, it sometimes may be advantageous to transfer power from one downhole device to another using the tubing 40 and/or casing 30 as electrical conductors or power transmission paths between them. Such a power distribution method depends on the provision of control communications to configure the connections between the power storage modules in each downhole device and a load that may be in another downhole device. Such control communications may be provided by internal electronics with one or more downhole devices, it may be provided by the surface computer system 52, or a combination of these. Hence, the power available from more than one downhole devices in a group may be applied to a single point of use, allowing higher power consumption at that point of use than would be allowed if each downhole device merely relied on only its own local power storage capacity. Similarly in the case where power storage within an individual downhole device has failed, that device may be powered from adjacent devices. Thus, the failed power storage devices may be removed from service without eliminating the use of the downhole device that suffered the power storage failure.

In other possible embodiments of the present invention having multiple downhole devices (not shown), each downhole device 50 comprises power storage devices 112 that may power the downhole device 50 alone or may be switched to apply power to the tubing 40 and/or casing 30. Each downhole device 50 may draw power only from its own local storage devices 112, or have its local power augmented by drawing power from the tubing 40 and/or casing 30. In the latter case the power can be drawn from other storage devices 112 in neighboring downhole devices 50, as described above, and/or from the surface power source 54.

In still other possible embodiments of the present invention, each switch of the first and second switch groups 121, 122 can be independently opened or closed to provide a variety of voltage levels to the load or loads by changing the switch positions. Thus, separate independent output voltages can be provided to a variety of loads, for multiple loads, or for a variety of load conditions, while retaining the ability to charge all of the storage devices 112 in parallel at a low voltage.

The components of the downhole device 50 may vary to form other possible embodiments of the present invention. Some possible components that may be substituted for or added to the components of the downhole device include (but are not limited to): an electric servo, another electric motor, other sensors, transducers, an electrically controllable tracer injection device, an electrically controllable chemical injection device, a chemical or tracer material reservoir, an electrically controllable valve, a relay modem, a transducer, a computer system, a memory storage device, a microprocessor, a power transformer, an electrically controllable hydraulic pump and/or actuator, an electrically controllable pneumatic pump and/or actuator, or any combination thereof.

Also, the components of a power storage module 90 may vary, but it will always has at least one power storage device 112 as a minimum. For example, the power storage module 90 may be as simple as a single power storage device 112 and some wires to electrically connect it. The power storage module 90 may be very complex comprising, for example, an array of power storage devices 112, a microprocessor, a memory storage device, a control card, a digital power meter, a digital volt meter, a digital amp meter, multiple switches, and a modem. Or, the power storage module 90 may be somewhere in between, such as the power storage It will be appreciated by those skilled in the art having the benefit of this disclosure that this invention provides a petroleum production well and a method of operating the well to provide power and power storage downhole. It should be understood that the drawings and detailed description herein are to be regarded in an illustrative rather than a restrictive manner, and are not intended to limit the invention to the particular forms and examples disclosed. On the contrary, the invention includes any further modifications, changes, rearrangements, substitutions, alternatives, design choices, and embodiments apparent to those of ordinary skill in the art, without departing from the spirit and scope of this invention, as defined module 90 of the preferred embodiment described herein and shown in FIGS. 1, 4, and 5.

The present invention can be applied to any type of petroleum well (e.g., exploration well, injection well, production well) where downhole power is needed for electronics or electrical equipment. The present invention also may be applied to other types of wells (other than petroleum wells), such as a water production well.

The present invention can be incorporated multiple times into a single petroleum well having one or more production zones, or into a petroleum well having multiple lateral or horizontal completions extending therefrom. Because the configuration of a well is dependent on the natural formation layout and locations of the production zones, the number of applications and arrangement of an embodiment of the present invention may vary accordingly to suit the formation, or to suit the well injection or production needs by the following claims. Thus, it is intended that the following claims be interpreted to embrace all such further modifications, changes, rearrangements, substitutions, alternatives, design choices, and embodiments.

The invention claimed is:

1. A system adapted to provide power to a downhole device in a well, comprising:

a current impedance device being generally configured for concentric positioning about a piping structure of said well to, at least in part, define a conductive portion for conveying a time-varying electrical current through and along said conductive portion of said piping structure; and a power storage device adapted to be electrically connected to said conductive portion of said piping structure, said storage device being adapted to be recharged by said time-varying electrical current and being adapted to be electrically connected to said downhole device to provide power to said downhole device.

2. A system in accordance with claim 1, wherein said power storage device comprises a chemical secondary cell.

3. A system in accordance with claim 1, wherein said power storage device comprises a rechargeable battery.

4. A system in accordance with claim 1, wherein said power storage device comprises a capacitor.

5. A system in accordance with claim 1, wherein said current impedance device is an unpowered induction choke comprising a ferromagnetic material, and said current impedance device being adapted to function as an inductor to said time-varying current due to its size, geometry, spatial relationship to the piping structure, and magnetic properties.

6. A system in accordance with claim 1, wherein said piping structure comprises at least a portion of a production tubing of said well.

7. A system in accordance with claim 1, wherein said piping structure comprises at least a portion of a well casing of said well.

8. A system in accordance with claim 1, further comprising a power conditioning circuit adapted to switch between a charging electrical circuit configuration and a discharging electrical circuit configuration for said power storage module.

9. A system in accordance with claim 8, further comprising a logic circuit adapted to automatically control said power conditioning circuit.

10. A petroleum well for producing petroleum products, comprising:

a piping structure comprising and an electrically conductive portion extending generally between the surface and downhole;

a power source on the surface electrically connected to said electrically conductive portion of said piping structure, said power source being adapted to output time-varying current;

an impedance device located about said electrically conductive portion of said piping structure;

a downhole power storage module comprising a power storage device and coupled to said electrical conductive; and an electrically powered device located downhole and being electrically connected to said power storage module.

11. A petroleum well in accordance with claim 10, wherein said electrically powered device comprises a sensor.

12. A petroleum well in accordance with claim 10, wherein said electrically powered device comprises a transducer.

13. A petroleum well in accordance with claim 10, wherein said electrically powered device comprises an electrically controllable valve.

14. A petroleum well in accordance with claim 10, wherein said electrically powered device comprises an electric motor.

15. A petroleum well in accordance with claim 10, wherein said electrically powered device comprises a modem.

16. A petroleum well in accordance with claim 10, wherein said electrically powered device comprises a chemical injection system.

17. A petroleum well in accordance with claim 10, wherein said piping structure comprises at least a portion of a production tubing of said well, and wherein said electrical return comprises at least a portion of a well casing.

18. A petroleum well in accordance with claim 10, wherein said piping structure comprises at least a portion of a well casing of said well.

19. A petroleum well in accordance with claim 10, wherein said electrical return comprises an earth return.

20. A petroleum well in accordance with claim 10, further comprising a power conditioning circuit adapted to switch between a charging electrical circuit configuration and a discharging electrical circuit configuration for said power storage module.

21. A petroleum well in accordance with claim 20, further comprising a logic circuit adapted to automatically control said power conditioning circuit.

22. A petroleum well in accordance with claim 10, wherein said power storage device comprises a chemical secondary cell.

23. A petroleum well in accordance with claim 10, wherein said power storage device comprises a rechargeable battery.

24. A petroleum well in accordance with claim 10, wherein said power storage device comprises a capacitor.

25. A petroleum well for producing petroleum products comprising:

a well casing extending within a wellbore of said well;

a production tubing extending within said casing;

a power source located at the surface, said power source being electrically connected to, and adapted to output a time-varying electrical current into, at least one of said tubing and said casing;

a downhole power storage module being electrically connected to at least one of said tubing and said casing;

a downhole electrically powered device being electrically connected to said power storage module;

a downhole induction choke being located about a portion of at least one of said tubing and said casing, and said induction choke being adapted to route part of said electrical current to said power storage.

26. A petroleum well in accordance with claim 25, wherein said induction choke is unpowered and comprises a ferromagnetic material.

27. A petroleum well in accordance with claim 25, wherein said power storage module comprises a chemical secondary cell.

28. A petroleum well in accordance with claim 25, wherein said power storage module comprises a rechargeable battery.

29. A petroleum well in accordance with claim 25, wherein said power storage module comprises a capacitor.

30. A petroleum well in accordance with claim 25, further comprising a power conditioning circuit adapted to switch between a charging electrical circuit configuration and a discharging electrical circuit configuration for said power storage module.

31. A petroleum well in accordance with claim 30, further comprising a logic circuit adapted to automatically control said power conditioning circuit.

32. A method of operating a petroleum well, comprising the steps of:

defining an electrically conductive of a piping structure in a borehole of the well at least in part by a current impedance device;

powering said electrically conductive portion of said piping structure, wherein said power source is adapted to output time-varying current;

storing electrical power in a downhole power storage module;

charging said power storage module with said time-varying current while producing petroleum products from said well; and discharging said power storage device as needed to power an electrically powered device located downhole while producing petroleum products from said well.

33. A method in accordance with claim 32, wherein said power storage module includes an electrically powered device comprising a sensor and a modem, and further comprising the steps of:

detecting a physical quantity within said well with said sensor; and transmitting said physical quantity to a surface device using said modem and via said piping structure.

34. A method in accordance with claim 33, wherein said transmitting is performed when said power storage device is not being charged by said power source.

35. A method in accordance with claim 32, the power storage module including a plurality of power storage devices, including the steps of:

charging the power storage devices in parallel;

discharging the power storage devices in series.

36. A method of powering a downhole device in a well, comprising the steps of:

(A) providing a downhole power storage module comprising a first group of electrical switches, a second group of electrical switches, two or more power storage devices, and a logic circuit;

(B) if current is being supplied to said power storage module, (1) closing said first switch group and opening said second switch group to form a parallel circuit across said storage devices, and (2) charging said storage devices;

(C) during charging, if said current being supplied to said power storage module stops flowing and said storage devices have less than a first predetermined voltage level, (1) opening said first switch group and closing said second switch group to form a serial circuit across said storage devices, and (2) discharging said storage devices as needed to power said downhole vice;

(D) during charging if said storage devices have more than said first predetermined voltage level, turning on a logic circuit; and (E) if said logic circuit is on, (1) waiting for said current being supplied to said power storage module to stop flowing, (2) if said current stops flowing, (i) running a time delay for a predetermined amount of time, (a) if said current starts flowing again before said predetermined amount of time passes, continue charging said storage devices, (b) if said predetermined amount of time passes, (b.1) opening said first switch group and closing said second switch group to form said serial circuit across said storage devices, (b.2) discharging said storage devices as needed to power said downhole device, (b.3) if said current starts flowing again, (b.3.1) closing said first switch group and opening said second switch group to form said parallel circuit across said storage devices, and (b.3.2) charging said storage devices, and (b.4) if said storage devices drop below a second predetermined voltage level, turning said logic circuit off.

37. A method in accordance with claim 36, further comprising the step of:

if said predetermined time passes on said time delay, if said current is not being supplied to said power storage module, and if said storage devices are above said second predetermined voltage level, transmitting data from said downhole device to a surface modem.

* * * * *